US006241573B1

(12) United States Patent
Ostendorff et al.

(10) Patent No.: US 6,241,573 B1
(45) Date of Patent: Jun. 5, 2001

(54) TOY VEHICLE TRACKSET HAVING PLURAL INTERSECTIONS

(75) Inventors: Eric C. Ostendorff, Torrance; Helena Bartok, Signal Hill; James Rhoden, Long Beach, all of CA (US)

(73) Assignee: Mattel, Inc., El Segundo ( * ) Notice: Subject to any disclaimer, the term of this patent is extended or adjusted under 35 U.S.C. 154(b) by 0 days.

(21) Appl. No.: 09/501,872

(22) Filed: Feb. 10, 2000

(51) Int. Cl.[7] ..... A63H 18/06
(52) U.S. Cl. ..... 446/444; 446/429
(58) Field of Search ..... 446/171, 172, 446/429, 430, 444; 463/58, 62, 68, 69; 104/53, 54, 55

(56) References Cited

U.S. PATENT DOCUMENTS

| | | | |
|---|---|---|---|
| 678,243 | | 7/1901 | Green . |
| 1,040,125 | | 10/1912 | Bickford . |
| 2,992,598 | | 7/1961 | Einfalt . |
| 4,091,561 | | 5/1978 | Kimura . |
| 4,128,964 | | 12/1978 | Ogasawara . |
| 4,254,576 | | 3/1981 | Matsumoto et al. . |
| 4,357,778 | | 11/1982 | Matsumoto et al. . |
| 4,401,305 | | 8/1983 | Sano . |
| 4,513,966 | * | 4/1985 | Mucaro et al. ..... 273/68 B |
| 4,558,867 | * | 12/1985 | Hippely ..... 273/412 |
| 4,605,230 | | 8/1986 | Halford et al. . |
| 5,205,554 | | 4/1993 | Copson . |
| 5,452,893 | | 9/1995 | Faulk et al. . |
| 5,643,040 | | 7/1997 | Hippely et al. . |
| 5,785,573 | | 7/1998 | Rothbarth et al. . |
| 5,899,789 | | 5/1999 | Rehkemper et al. . |

FOREIGN PATENT DOCUMENTS

9949948 * 7/1999 (WO) .

* cited by examiner

*Primary Examiner*—Jacob K. Ackun, Jr.
*Assistant Examiner*—Jeffrey D. Carlson
(74) *Attorney, Agent, or Firm*—Roy A. Ekstrand

(57) ABSTRACT

A toy vehicle trackset includes a base supporting a vertically extending tower. A toy vehicle trackway includes a vertically rising portion supported by the tower which transitions to a vertical loop and a plurality of helically arranged downwardly spiraling track loop portions. The track loop portion form intersections with the vertically rising portion of the track. Each intersection is covered by a shroud to prevent injury to a child user in the event of collisions within a given intersection. The trackway includes a return which is coupled to a toy vehicle accelerator whereby toy vehicles repeatedly cycle through the trackway set.

8 Claims, 3 Drawing Sheets

TOY VEHICLE TRACKSET HAVING PLURAL INTERSECTIONS

FIELD OF THE INVENTION

This invention relates generally to toy vehicle tracksets and particularly to those having trackset intersections.

BACKGROUND OF THE INVENTION

Toy vehicle tracksets are well known in the art and have enjoyed substantial popularity for many years. While such toy vehicle tracksets have varied broadly, most employ a trackway having a plurality of track segments each having a travel path together with a guiding means such as raised sidewalls or the like. The basic operation of toy vehicle tracksets is found in the travel of one or more toy vehicles around the trackway. The toy vehicles typically used in toy vehicle tracksets are either powered or unpowered. Powered vehicles typically employ a propulsion system utilizing a wind-up spring-driven power source or a battery-powered electric motor. Still others utilize a small electric motor deriving operative power from conductors buried in the trackway. Unpowered toy vehicles used in toy vehicle tracksets are typically freewheeling and rely upon various energy sources to drive the vehicle around the trackway. The power sources may, for example, be simple gravity-driven systems using one or more inclined ramps for acceleration or, alternatively, may employ one of several types of acceleration devices. Acceleration devices may include launchers having a launching station from which the toy vehicle is accelerated using spring or air power. One of most prevalent acceleration devices utilizes one or more spinning wheels positioned adjacent a closed loop toy vehicle trackway. In such acceleration devices, the wheel or wheels are rotated at a high rotational speed and as a toy vehicle passes the spinning wheel or wheels, the wheel or wheels engage the toy vehicle and impart energy thereto.

One of the general objectives in the fabrication of toy vehicle tracksets is the provision of increased amusement, entertainment and play value. Thus, practitioners in the art have provided various types of action or stunt features in toy vehicle tracksets. Such stunt or action features have included jumps and loops as well as trackset intersections. In providing trackset intersections, the additional excitement provided arises from the possibility or actual occurrence of toy vehicle collisions at the intersections.

U.S. Pat. No. 5,899,789 issued to Rehkemper, et al. sets forth a TOY CAR TRACK ASSEMBLY WITH PROPELLING MECHANISM AND COLLISION COURSE having a continuous track comprising a spiral track section interconnecting upper and lower track sections. The spiral track section exits onto a powered roller assembly which receives a toy car from the spiral track and impels it along the track. The car leaving the rollers moves over and opening in a horizontal section and then through an inverted vertically disposed loop leading back to the opening to a lower track section and back to the spiral track section. The construction of the track creates a midair collision course potential for cars moving simultaneously through the intersection.

U.S. Pat. No. 4,091,561 issued to Kimura sets forth a TRAVELING ROAD SYSTEM OF A TOY having a supporting base from which a tower extends upwardly and which supports a helical ascending roadway supported thereon. A slide is freely movable vertically within the supporting column and supports a movable permanent magnet which may coupled to a toy vehicle carrying the toy vehicle upwardly upon the helical track.

U.S. Pat. No. 4,254,576 issued to Matsumoto, et al. sets forth a SPIN TOWER STATION FOR USE WITH TOY VEHICLE AND TRACKWAY having a tower supporting a plurality of trackways connecting a plurality of stations. The spin tower station which receives a vehicle at a station entry port and simultaneously moves it translationally and rotationally to a station exit port positioned below includes a base, two telescoping cylindrical elements extending upwardly from the base, a vehicle platform mounted on the upper element and a spiral flange on the upper element which engages a guide notch to rotate the upper element as it descends.

U.S. Pat. No. 4,357,778 issued to Matsumoto, et al. sets forth a TOY VEHICLE AND TRACKWAY having a base supporting a multiply curved and looped closed track together with a lift situated in the approximate center of the trackway loops.

U.S. Pat. No. 4,401,305 issued to Sano sets forth a SIMULATED RACING GAME having a closed generally oval track defining a rising portion and a descending portion. A plurality of endless belts move upon the track and carry toy vehicles thereon.

U.S. Pat. No. 5,205,554 issued to Copson sets forth an INTERSECTING RACK TRACK WITH OBSTRUCTING MEANS TO PROMOTE COLLISIONS having two continuous tracks which include serpentine portions and which cross each other at several points. Except for the crossing points, the tracks are hidden by walls on their opposite side. Each player electrically controls a car with the object of completing one or more passes around its track or to prevent the other car from completing its track.

U.S. Pat. No. 678,243 issued to Green sets forth an AMUSEMENT RAILWAY having a closed track supported an inclined portion having a lift thereon and a miniature car coupled to and rollable upon the track.

U.S. Pat. No. 1,040,125 issued to Bickford sets forth a LOOP THE LOOP PLEASURE RAILWAY having a trackway supporting a pair of inclined ramps one of which includes a lift. The remaining ramp is coupled to a plurality of vertical loops and a return track.

U.S. Pat. No. 2,992,598 issued to Einfalt sets forth TOY SWITCHBACK OR SCENIC RAILWAYS having a closed track defining a plurality of curves and ramps. One ramp defines a series of friction engaging notches which engage the drive member of a toy railway car having the ability to climb the ramp.

U.S. Pat. No. 4,128,964 issued to Ogasawara sets forth a TRANSFER MECHANISM INTENDED FOR USE IN TOYS having a multiply curved track supported by a central tower. The tower includes a movement member pivotally coupled at the upper end of the tower for transferring so-called "ball people" type figures between the ramp portions.

U.S. Pat. No. 5,452,893 issued to Faulk, et al. sets forth a COMPETITIVE MULTI-LANE VEHICLE RACETRACK having a closed loop multi-lane racetrack defining a pair of curves and a pair of straight-aways. One of the straight-aways is inclined and supports an endless belt for operatively lifting toy vehicles from the lower end thereof to the upper end and discharging them to return downwardly upon the track.

U.S. Pat. No. 5,785,573 issued to Rothbarth, et al. sets forth a KINETIC TOY having a plurality of balls rolled down a trackway from an upper location to a lower location. The balls are automatically returned to the upper location by an elevator mechanism for repeat travels down the trackway.

U.S. Pat. No. 4,605,230 issued to Halford, et al. sets forth a TOY VEHICLE GAME WITH LAUNCHER AND RETURN MEANS having a pair of intersecting track segments each having a vehicle launcher at one end and an elastic rebound mechanism at the opposite end. The intersection provides the opportunity for collisions of toy vehicles.

U.S. Pat. No. 5,643,040 issued to Hippely, et al. sets forth a TOY VEHICLE PLAYSET HAVING VEHICLE RECEIVING AND HOLDING STATION including a trackway and launcher having a receiving station at the end of the trackway which facilitates the serial feeding of toy vehicles to a further holding station using a tiltable hand-manipulated ramp.

While the foregoing described prior art devices have to some extent improved the art and in some instances enjoyed commercial success, there remains nonetheless a continuing need in the art for evermore interesting and improved toy vehicle tracksets.

SUMMARY OF THE INVENTION

Accordingly, it is a general object of the present invention to provide an improved toy vehicle trackset. It is a more particular object of the present invention to provide an improved toy vehicle trackset which may be played by a single participant in a collision avoiding or collision precipitating manner to increase vehicle playset excitement.

In accordance with the present invention, there is provided a toy vehicle trackset comprising: a plurality of toy vehicles; a base having an upwardly directed chute; a vertical tower supported by the base; a toy vehicle accelerator; a toy vehicle trackway for guiding the travel of a toy vehicle, the trackway including a vertically ascending portion coupled to the chute and rising upon the tower, a plurality of downwardly inclined helical loops forming a plurality of intersections with the vertically ascending portion and a return portion including the toy vehicle accelerator; and a plurality of shrouds each covering one of the plurality of intersections.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
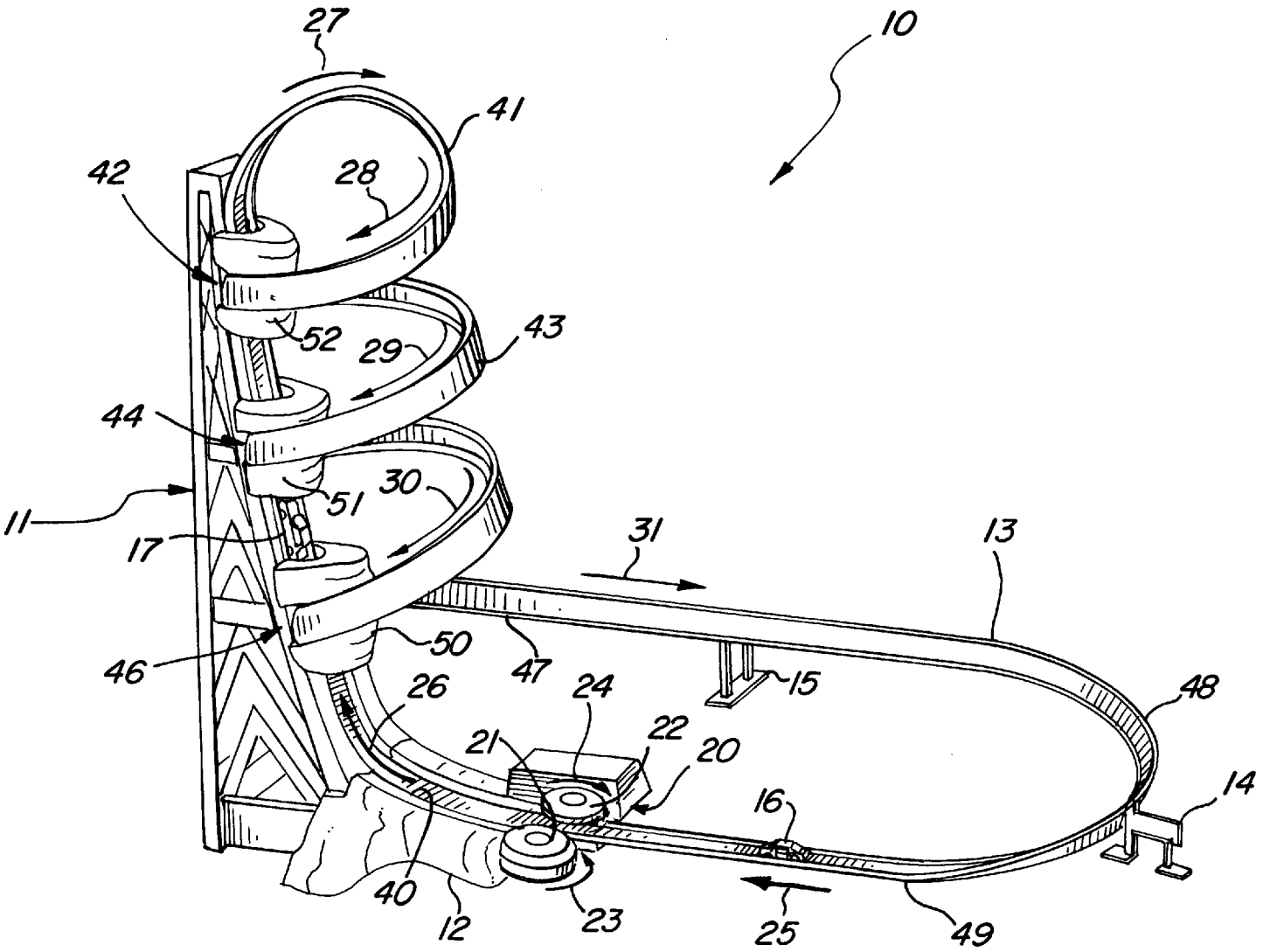
FIG. 1 sets forth a perspective view of a toy vehicle trackset constructed in accordance with the present invention.

FIG. 1 sets forth a perspective view of a toy vehicle trackset constructed in accordance with the present invention and generally referenced by numeral 10. Trackset 10 includes a vertically extending tower 11 supported by a base 12. Base 12 further includes a battery-powered accelerator station 20 having a pair of spinning rollers 21 and 22. Trackset 10 further includes a vertically transitioning upper chute 40 supported by tower 11. A toy vehicle trackway 13 preferably formed of a molded plastic material or the like extends upwardly from chute 40 along tower 11 to a vertical loop 41. Loop 41 transitions to a plurality of horizontal and downward spiral loop portions 43 and 45. Loop 41 forms an intersection 42 on tower 11 while loops 43 and 45 form intersections 44 and 46 respectively upon tower 11. Loop 45 transitions to an exit loop 47 which in turn is coupled to a return curve 48 and a trackway return 49. Toy trackway 13 is further supported by a pair of trackway supports 14 and 15.

In further accordance with the present invention, intersections 42, 44 and 46 are covered by hollow shrouds 52, 51 and 50 respectively.

In operation, a toy vehicle such as toy vehicle 16 is shown entering accelerator 20 in the direction indicated by arrow 25. In the preferred fabrication of the present invention, toy vehicle 16 is unpowered and freely rolling upon toy vehicle trackway 13. For further illustration, an additional toy vehicle 17 is shown rising upwardly against tower 11 having been previously launched by accelerator 20. Accelerator 20 is fabricated in accordance with conventional fabrication techniques and provides a pair of rapidly spinning rollers 21 and 22. Rollers 21 and 22 spin in the directions indicated by arrows 23 and 24. Accordingly, as toy vehicle 16 enters accelerator station 20, rollers 22 and 23 engage toy vehicle 16 and rapidly accelerate it up chute 40 in the direction indicated by arrow 26. In the anticipated play pattern of the present invention toy vehicle trackset, a plurality of toy vehicles are simultaneously operating upon toy vehicle trackway 13. The user is able to exercise some timing by determining when each toy vehicle is moved into accelerator station 20. Accelerator station 20 rapidly accelerates the toy vehicles with sufficient energy to cause the toy vehicles to travel upwardly as indicated by arrow 26 and leave tower 11 entering loop 41 as indicated by arrow 27. Thereafter, centrifugal force maintains the toy vehicle against loop 41 as it descends in the direction indicated by arrow 28 entering intersection 42. As is better seen in FIG. 3, intersection 42 provides a crossing of the trackway descending from loop 41 and the upwardly ascending portion of trackway supported by tower 11. Thus, simultaneous presence of toy vehicles within intersection 42 results in a collision therein. Shroud 52 maintains the safety of intersection 42 by confining the trajectories of intersecting or colliding toy vehicles within intersection 42.

In the absence of a collision within intersection 42, the launched toy vehicle transitions through loop 43 downwardly in the direction indicated by arrow 29 and enters intersection 44. Once again, intersection 44 is substantially identical to intersection 42 and is covered by shroud 51. In the event a toy vehicle such as toy vehicle 17 is entering the upward track within intersection 44 at the same time as a descending vehicle leaves loop 43 and enters intersection 44, a collision will likely result.

In the absence of a collision within intersection 44, the descending toy vehicle traverses loop 45 in the direction indicated by arrow 30 entering intersection 46. Once again, should simultaneous toy vehicles be traveling through intersection 46, a collision will occur. In the absence of a collision within intersection 46, the descending toy vehicle exits the loop structure at exit loop 47 in the direction indicated by arrow 31. The descending toy vehicle having left exit loop 47 continues around return curve 48 and return 49 to again approach accelerator station 20. At accelerator station 20, the toy vehicle is again accelerated up chute 40 and the process continues.

In the anticipated play pattern of the present invention, a number of toy vehicles are rapidly and repeatedly placed upon trackway 13 and pushed into accelerator station 20. Thereafter, the user is able to observe as the plurality of toy vehicles is rapidly launched upwardly through tower 11 and descends through loops 41, 43 and 45 ultimately returning to accelerator station 20.

Figure 2:
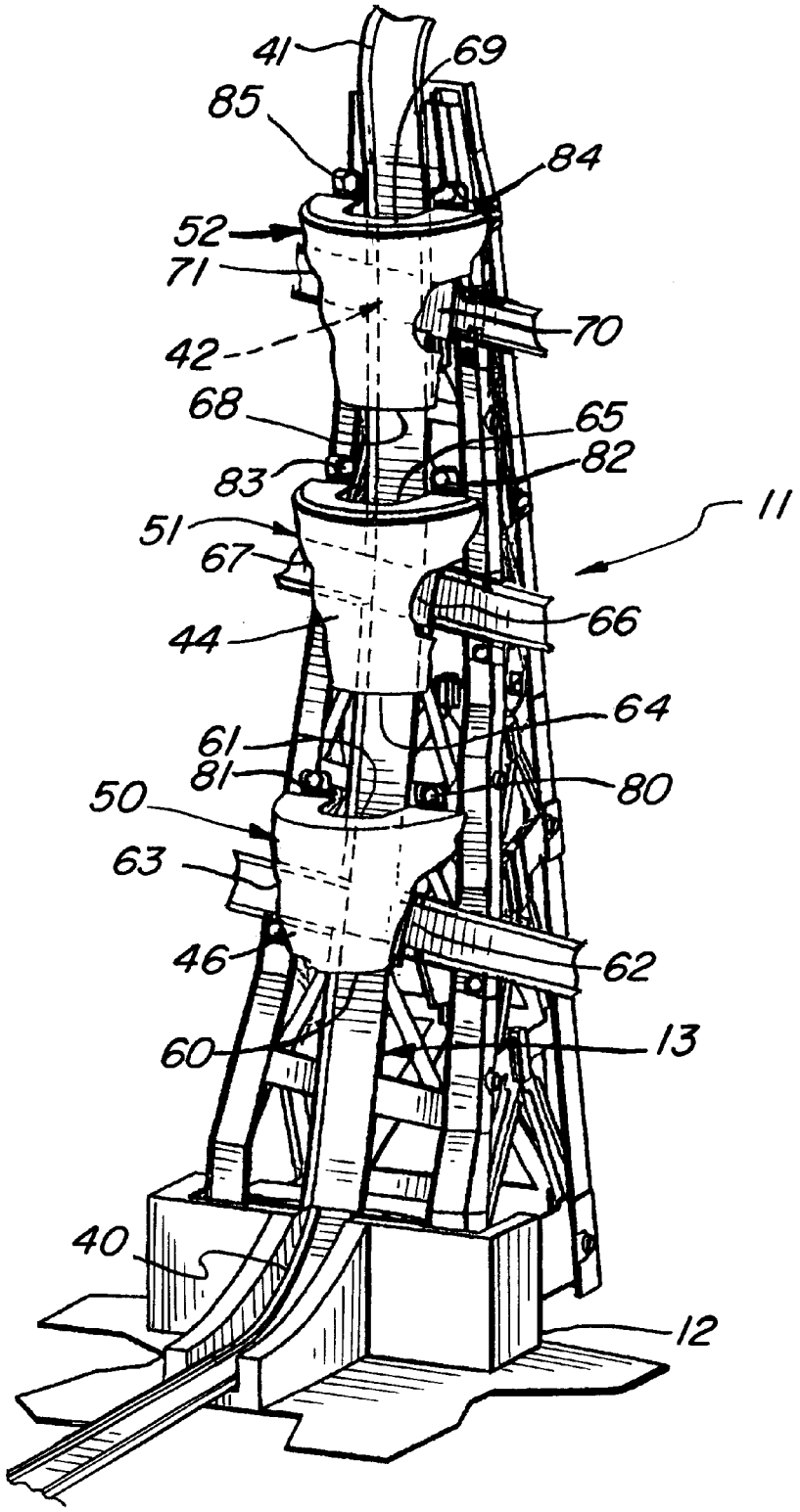
FIG. 2 sets forth a partially sectioned perspective view of the tower portion of the present invention toy vehicle trackset.

FIG. 2 sets forth a partially sectioned perspective view of tower 11 and supported track segments of the present invention toy vehicle trackset. For purposes of illustration of the structure of tower 11, FIG. 2 omits accelerator station 20 as well as loops 41, 43, 45 and exit loop 47.

More specifically, tower 11 is supported by a base 12 which defines an upwardly transitioning chute 40. Tower 11 supports a vertically ascending portion of trackway 13 which, as is seen in FIG. 1, transitions to a vertical loop 41. Trackway 13 further includes a plurality of intersections 42, 44 and 46 which, as is described above in FIG. 1, are formed by the intersection of the vertically ascending portion of trackway 13 with loop portions 41, 43 and 45 of trackway 13.

In accordance with the present invention, intersections 42, 44 and 46 are partially covered by a plurality of shrouds 52, 51 and 50 respectively. The structure of shrouds 50 through 52 is substantially identical and is shown in greater detail in FIG. 3. Shrouds 50, 51 and 52 are substantially identical and are preferably formed of a relatively thin material such as molded plastic or the like. Each of shrouds 50 through 52 defines an opposed pair of vertically oriented apertures and an opposed pair of side apertures which facilitate toy vehicle travel in either a vertical or sideways descending direction beneath the shrouds.

Thus, shroud 50 is secured to tower 11 by a pair of fasteners 80 and 81 and defines a pair of vertical apertures 60 and 61 as well as a pair of side apertures 62 and 63. Similarly, shroud 51 is secured to tower 11 by a pair of fasteners 82 and 83 and defines vertical apertures 64 and 65 together with side apertures 66 and 67. Finally, shroud 52 which is shown in greater detail in FIG. 3 is secured to tower 11 by a pair of fasteners 85 and defines vertical apertures 68 and 69 together with side apertures 70 and 71.

As described above, shrouds 50, 51 and 52 are substantially identical. Each shroud functions to partially enclose a respective one of intersections 46, 44 and 42 to protect the user against potential injury as toy vehicles collide within the intersections. In the preferred fabrication of the present invention, the excitement of the play pattern may be enhanced by selecting the material which forms shrouds 50, 51 and 52. For example, in some instances an opaque material may be utilized and may be preferred. In other instances, however, shrouds 50 through 52 may be found more interesting and exciting if formed from a translucent or transparent material. In addition, the outer shape of shrouds 50 through 52 may be selected in accordance with a particular appearance theme.

Figure 3:
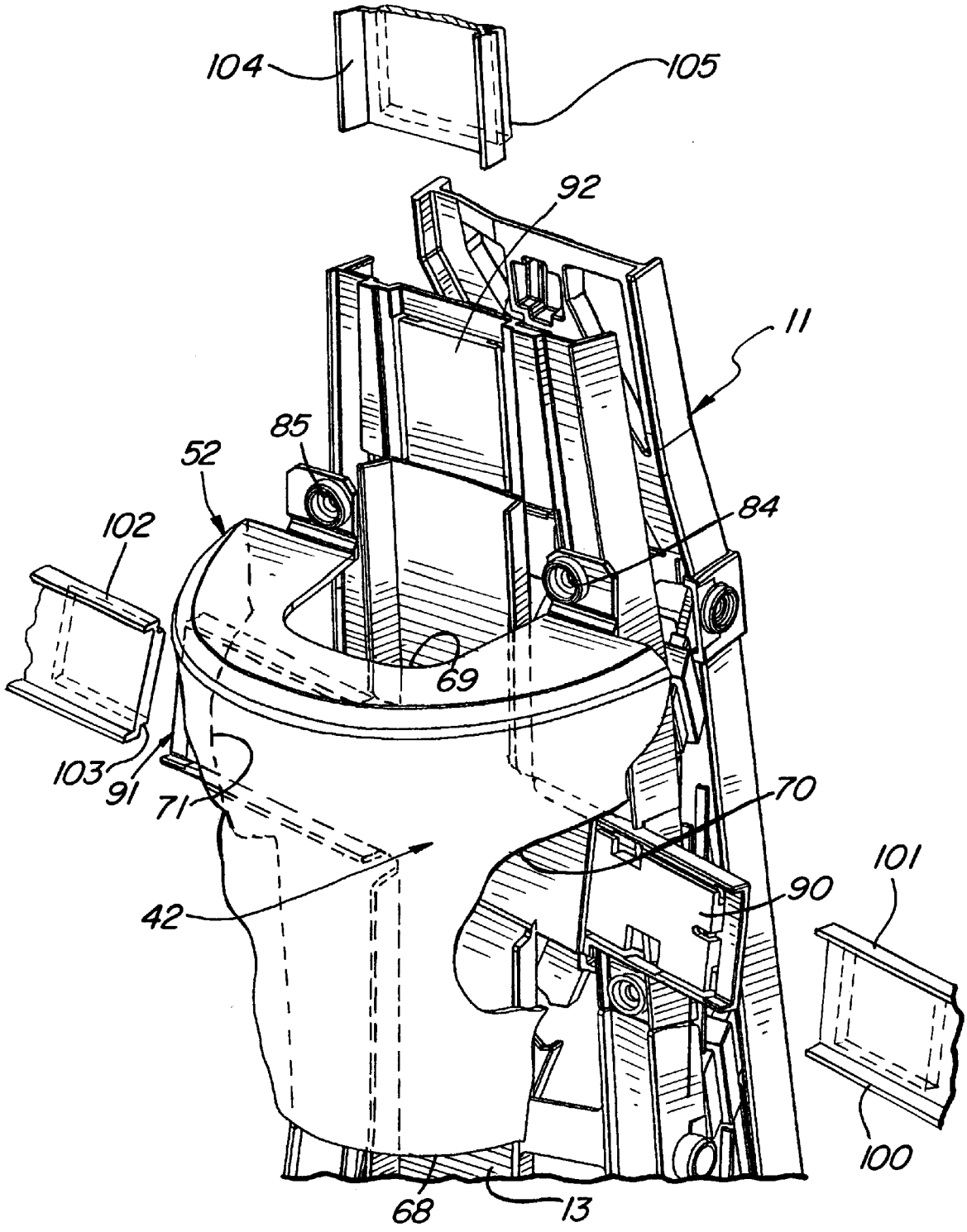
FIG. 3 sets forth a partial perspective assembly view of an intersection of the present invention toy vehicle trackset.

FIG. 3 sets forth a partial perspective assembly view of tower 11 supporting shroud 52. Once again, it will be remembered that the structure of intersection 42 and shroud 42 upon tower 11 is substantially identical to intersections 44 and 46 of shrouds 51 and 50 respectively. Accordingly, the descriptions in FIG. 3 relating to shroud 52 and intersection 42 will be understood to apply equally well to the remaining shrouds and intersections of the present invention trackset.

More specifically, tower 11 supports a vertically ascending portion of trackway 13 together with a transverse section forming an intersection 42. A track coupler 90 fabricated in accordance with conventional fabrication techniques receives a track segment 100 having a cooperating coupler 101. Similarly, intersection 42 includes a track coupler 91 cooperating with a coupler 103 of track segment 102. Thus, track segments 100 and 102 are fitted upon and secured to couplers 90 and 91 respectively to provide the transition portions of loop 41 and loop 43 to and from intersection 42 (loops 42 and 43 seen in FIG. 1). Trackway 13 further includes a track coupler 92 which cooperates with a coupler 105 formed on track segment 104. Thus, track segment 104 is securable to trackway 13. As is seen in FIG. 1, the upwardly extending portion of trackway 13 forms loop 41. Thus, with reference to FIG. 3, it will be seen that track segment 104 forms the initial portion by which trackway 13 transitions to loop 41.

A shroud 52 fabricated of a thin plastic material or the like is secured to tower 11 by a pair of conventional fasteners 84 and 85. Shroud 52 defines an aperture 68 on the bottom portion thereof and an aperture 69 on the upper portion thereof. In addition, shroud 52 defines a pair of side apertures 70 and 71. Thus, in accordance with the present invention, shroud 52 covers intersection 42 while allowing toy vehicles to rise vertically beneath shroud 52 and descend sideways beneath shroud 52 passing through intersection 42.

What has been shown is a novel toy vehicle trackset having a base supporting a vertical tower within which a vertically rising trackway portion is multiply intersected by descending helical loops. Each intersection is covered with a protective safety shroud to prevent injury to a child user as the trackset is being played with.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy vehicle trackset comprising:

a base having a vertically transitioning chute;

a tower supporting a vertically ascending trackway portion coupled to said chute, said ascending trackway portion having an upper end;

a vertical loop trackway portion coupled to said upper end;

a downwardly angled helical trackway portion, coupled to said vertical loop trackway portion, forming a plurality of intersections with said vertically ascending trackway portion; and a plurality of shrouds covering said plurality of intersections.

2. The toy vehicle trackset set forth in claim 1 having a plurality of toy vehicles wherein said trackset further includes a return trackway portion coupled from said helical trackway portion to said vertically transitioning chute.

3. The toy vehicle trackset set forth in claim 2 further including a toy vehicle accelerator.

4. The toy vehicle trackset set forth in claim 3 wherein said toy vehicle accelerator is located within said return trackway portion.

5. The toy vehicle trackset set forth claim 4 wherein said shrouds each include:

a generally thin member having a pair of vertically aligned apertures and a pair of side apertures; and means for attaching said shroud to said tower.

6. A toy vehicle trackset comprising:

a plurality of toy vehicles;

a base having an upwardly directed chute;

a vertical tower supported by said base;

a toy vehicle accelerator;

a toy vehicle trackway for guiding the travel of a toy vehicle, said trackway including a vertically ascending portion coupled to said chute and rising upon said tower, a plurality of downwardly inclined helical loops forming a plurality of intersections with said vertically ascending portion and a return portion including said toy vehicle accelerator; and a plurality of shrouds each covering one of said plurality of intersections.

7. The toy vehicle trackset set forth in claim 6 wherein said plurality of downwardly inclined helical loops includes a trio of loops forming a trio of said intersections.

8. The toy vehicle trackset set forth claim 7 wherein said shrouds each include:

a generally thin member having a pair of vertically aligned apertures and a pair of side apertures; and means for attaching said shroud to said tower.

* * * * *